US008608403B2

(12) United States Patent
Thiesse

(10) Patent No.: US 8,608,403 B2
(45) Date of Patent: Dec. 17, 2013

(54) MAGNETIC VIBRATORY COMPACTOR

(75) Inventor: Ryan T. Thiesse, Otsego, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 17 days.

(21) Appl. No.: 13/432,872

(22) Filed: Mar. 28, 2012

(65) Prior Publication Data

US 2013/0259570 A1 Oct. 3, 2013

(51) Int. Cl.
*E01C 19/28* (2006.01)

(52) U.S. Cl.
USPC ..... 404/117; 404/122

(58) Field of Classification Search
USPC ..... 404/113, 114, 117, 122, 133.05–133.2; 318/114; 74/86, 87
See application file for complete search history.

(56) References Cited

U.S. PATENT DOCUMENTS

| | | | | |
|---|---|---|---|---|
| 3,053,157 | A | 9/1962 | Martin | |
| 3,830,099 | A | 8/1974 | Ichikawa | |
| 4,330,738 | A | 5/1982 | Paramythioti et al. | |
| 4,947,067 | A | 8/1990 | Habermann et al. | |
| 5,797,699 | A | 8/1998 | Blancke et al. | |
| 6,698,974 | B2 | 3/2004 | Codina et al. | |
| 6,742,960 | B2 | 6/2004 | Corcoran et al. | |
| 6,829,986 | B2 | 12/2004 | Richter | |
| 2005/0147469 | A1 * | 7/2005 | Miskin | 404/117 |
| 2008/0157702 | A1 | 7/2008 | Pais et al. | |

FOREIGN PATENT DOCUMENTS

JP 407303349 A * 11/1995 ..... H02K 7/065

* cited by examiner

*Primary Examiner* — Raymond W Addie
(74) *Attorney, Agent, or Firm* — Leydig, Voit & Mayer

(57) ABSTRACT

A machine comprising a vibratory compactor assembly having a cylindrical drum connected to the machine with an axle. The assembly has a shaft extending concentrically through the center of the cylindrical drum that has a first end and a second end. The shaft has an electromagnet between its first end and second end. The electromagnet can receive electric current to create a magnetic field that applies an attractive magnetic force between the shaft and the drum that pulls the shaft and at least a portion of the drum toward one another.

20 Claims, 7 Drawing Sheets

MAGNETIC VIBRATORY COMPACTOR

TECHNICAL FIELD

This patent disclosure relates generally to compactor machines and, more particularly, vibratory compactors on said type of machines.

BACKGROUND

Compactor machines are typically used for soil, landfill, and paving applications to maximize material density. Compaction can occur in various ways, such as with a rolling drum, a vibrating drum, or tamping wheel tips. Traditionally, vibrating drums are vibrated using an interior shaft with an eccentric weight that rotates around the shaft. The eccentric weight can rotate around the shaft at varying speeds to vibrate the drum at varying frequencies, but the amplitude of the vibrations is determined by the size of the weights used.

SUMMARY

The disclosure describes, in one aspect, a machine having a vibratory compactor assembly. The vibratory compactor assembly has a cylindrical drum connected to the machine by at least one axle. The vibratory compactor assembly also has a shaft extending concentrically at least through the center of the cylindrical drum. The shaft has a first end and a second end, and the first end is connected to one of the caps. The vibratory compactor assembly also has at least one electromagnet on the shaft between the shaft's first end and the shaft's second end. The electromagnet is configured to receive electric current to create a magnetic field that applies an attractive magnetic force between the shaft and the drum that pulls the shaft and at least a portion of the drum toward one another.

In another aspect, the disclosure describes a vibratory compactor assembly having a cylindrical drum. The vibratory compactor assembly also has a shaft extending concentrically at least through the center of the cylindrical drum. The shaft has a first end and a second end and has at least one electromagnet between its first end and its second end. The electromagnet can receive electric current to create a magnetic field that applies an attractive magnetic force between the shaft and the drum that pulls the shaft and at least a portion of the drum toward one another.

In another aspect, the disclosure describes a method of vibratory compaction that includes providing a vibratory compactor assembly. The vibratory compactor assembly includes a cylindrical drum. The assembly also has a shaft that extends concentrically through the center of the cylindrical drum that has a first end and a second end. The shaft has an electromagnet between the shaft's first end and the shaft's second end. The electromagnet can receive electric current to create a magnetic field that applies an attractive magnetic force between the shaft and the drum that pulls the shaft and at least a portion of the drum toward one another.

DETAILED DESCRIPTION

Figure 1:
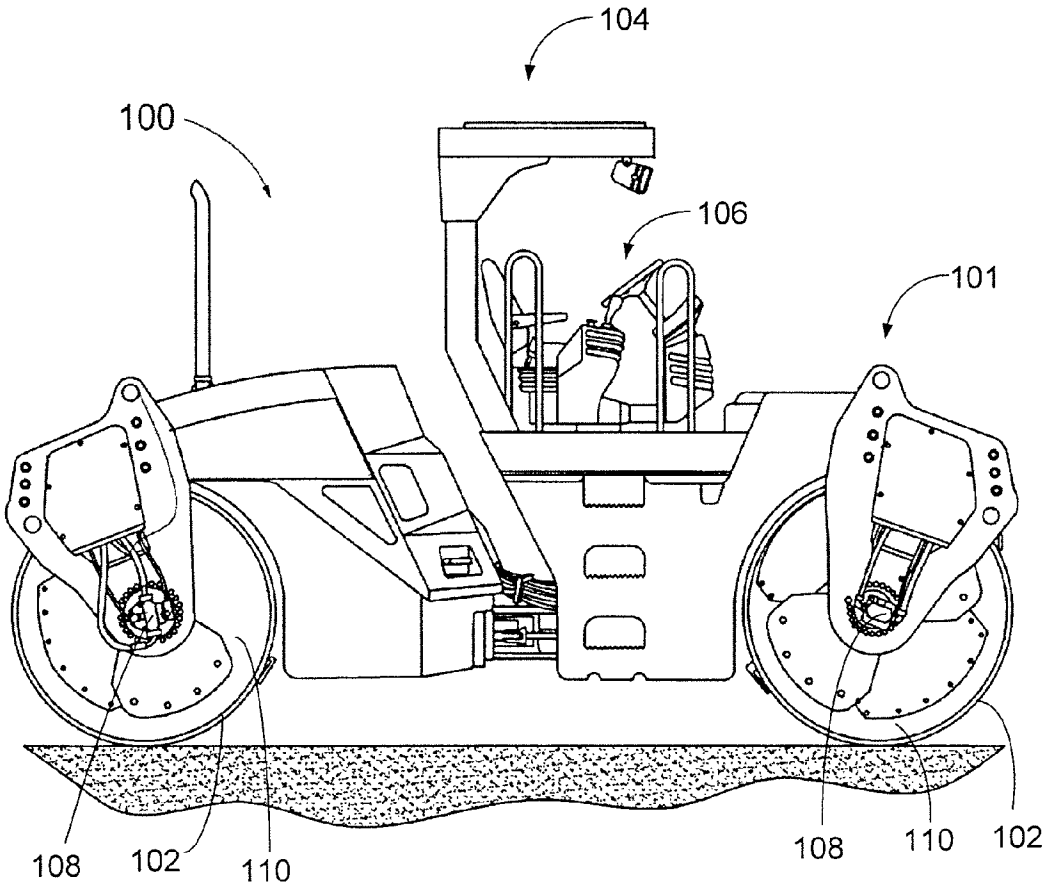
FIG. 1 is an outline view of one example of a machine having a magnetic vibratory compactor assembly in accordance with the disclosure.

This disclosure relates to a machine 100 having a vibratory compactor assembly 101 included within one cylindrical drum 102. The machine 100 generally has a cab 104 containing various controls 106 that allow an operator to control the machine, as shown in FIG. 1. The operator can control the direction and speed of the machine's 100 travel, as well as various other systems including the operation of the vibratory compactor assembly 101. While the arrangement in FIG. 1 is illustrated in connection with a vibratory asphalt compactor, the arrangement disclosed herein has universal applicability in various other types of machines as well. The term "machine" may refer to any machine that performs some type of operation associated with an industry such as mining, construction, farming, transportation, or any other industry known in the art. For example, the machine may be an earth-moving machine, such as a wheel loader, excavator, dump truck, backhoe, motor grader, material handler or the like. Moreover, an implement may be connected to the machine. Such implements may be utilized for a variety of tasks, including, for example, loading, compacting, lifting, brushing, and include, for example, buckets, compactors, forked lifting devices, brushes, grapples, cutters, shears, blades, breakers/hammers, augers, and others.

The machine 100 as shown includes two drums 102. Each drum 102 is connected to the machine 100 by one or more axles 108. The two drums 102 connect to the axles 108 at circular caps 110 of each drum, but machines with more or fewer drums are contemplated. The axles 104 rotatably connect the drum 102 to the machine 100 and also act as conduits for various utility lines such as electricity, pneumatics, or hydraulics to reach the interior of the drum.

Figure 2:
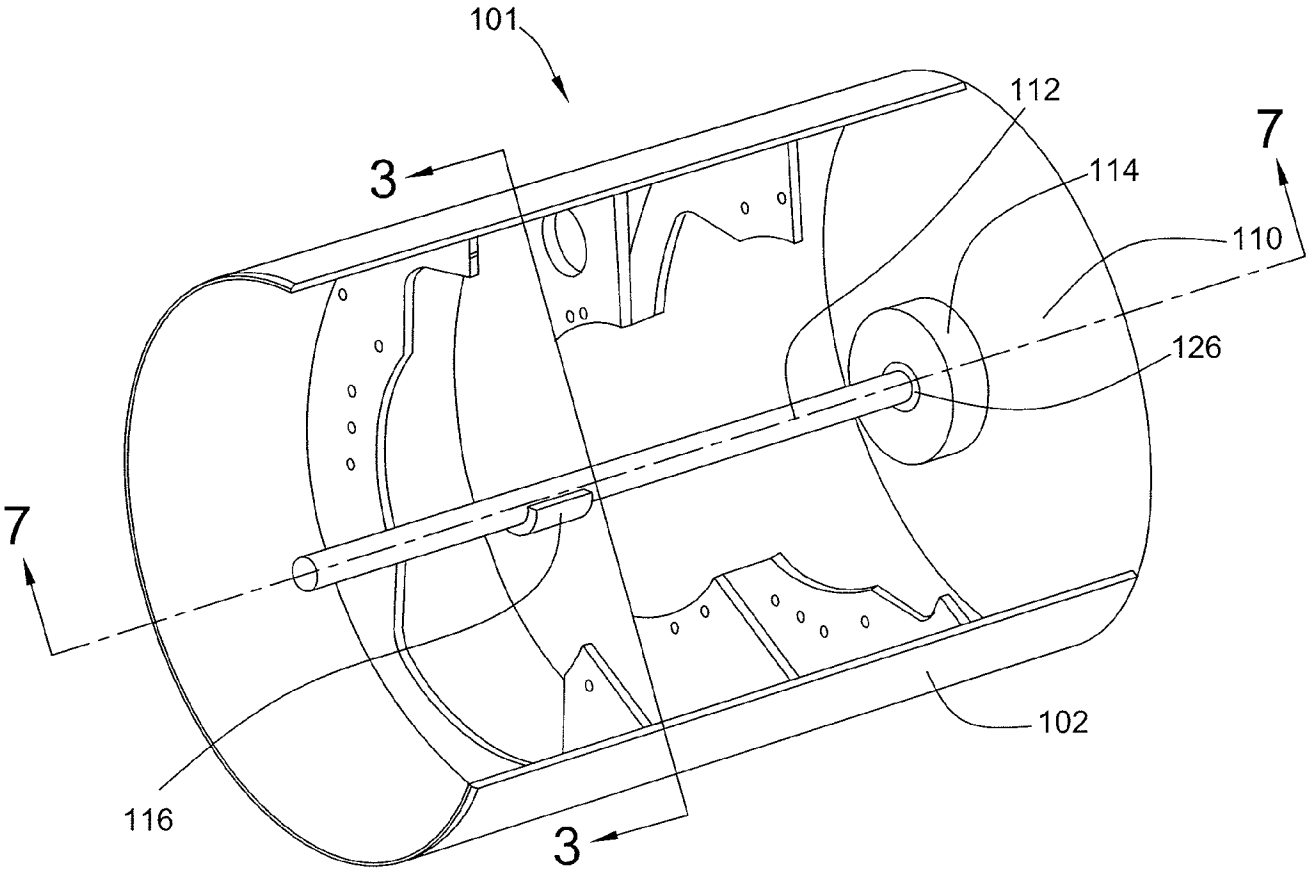
FIG. 2 is a cutaway perspective view of a drum of the magnetic vibratory compactor assembly in accordance with the disclosure.

FIG. 2 shows the interior of a drum 102 in a vibratory compactor assembly 101. A shaft 112 passes through the longitudinal axis of the drum's 102 interior and, in some embodiments, the shaft 112 is configured to rotate around its longitudinal axis. The shaft 112 has a first end and a second end. In some embodiments, the ends of the shaft 112 connect to the drum 102 caps 110 at a rotary bearing, which allows the shaft to rotate independently of the drum. While the shaft 112 in FIG. 2 is shown to have a generally cylindrical shape, shafts having other shapes can also be used. The shaft 112 has at least one electromagnet 116 attached to a portion of the shaft's circumference. In one embodiment, a motor 114 causes the shaft 112 to rotate in a direction opposite the rotation of the drum 112 such that the electromagnet 116 maintains a consistent orientation with respect to the ground. For example, FIG. 2 shows the electromagnet 116 on a portion of the shaft 112 facing downward. A sensor 120 determines the position or rate of drum 102 rotation and sends this information to a controller 123. The controller 123 uses the position or rotation rate information to determine the required shaft 112 rotation required to maintain a shaft position in which the electromagnet 116 is oriented downward. The controller 123 then activates the motor 114 as appropriate to maintain shaft 102 orientation. In one embodiment, the rotation rate of the shaft 112 is substantially the same as that of the drum 102, but in the opposite direction.

Alternatively, the motor 114 represented in FIG. 2 can be a gearing mechanism 114. The gearing mechanism 114 causes the shaft 112 to rotate opposite to the drum 102. Such a gearing mechanism 114 can link to the drum 102 and the shaft 112, and be geared such that the shaft rotates at the same rate as the drum, but in the opposite direction. The result of using either a motor 114 or a gearing mechanism 114 is that the shaft 112 rotates relative to the drum 102 but does not rotate relative to the ground or the rest of the machine 100. In other embodiments, the shaft 112 is weighted such that the majority of the shaft's weight is on the bottom portion of the shaft's cross section and the shaft is allowed to rotate independently of the drum 102. In this way, the force of gravity on the shaft cross section prevents the shaft 112 from rotating along with the drum as the drum rotates, and keeps the shaft in a consistent orientation relative to the ground. In another embodiment, the shaft 112 is held in a static position relative to the machine 100 by operation of an orientation motor 114 while the drum 102 rotates around it. In this embodiment, the electromagnets 116 are always facing the same direction with respect to the ground regardless of the drum's 102 rotation.

Figure 3:
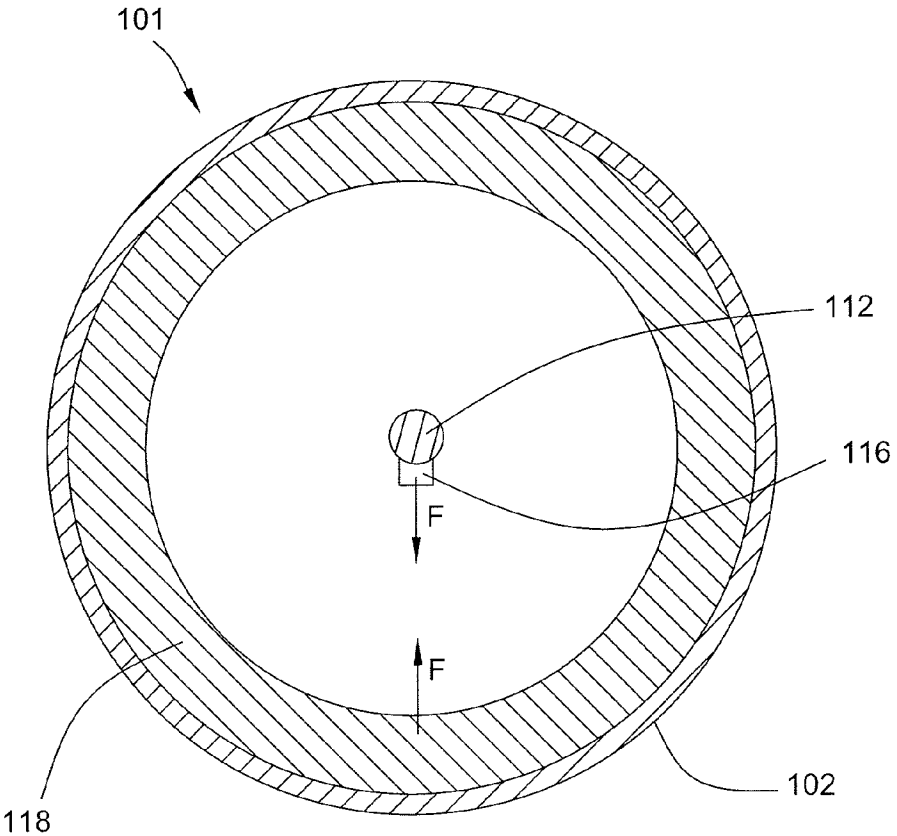
FIG. 3 is a side schematic view of a drum of the magnetic vibratory compactor assembly of FIG. 2.

When electric current is provided through the electromagnet 116, the electromagnet activates and produces a magnetic field that attracts ferrous materials such as iron, steel, and alloys thereof. As shown in the embodiment illustrated in FIG. 3, which is a cross section through the drum 102, the drum has a cylindrical metal base 118 that extends axially around the entire inner circumference of the drum. When the electromagnet 116 is activated, an attractive magnetic force, F, is created between the electromagnet and the metal base 118, which attracts a portion of the metal base 118 towards the shaft 112 on the drum's 102 longitudinal axis where the electromagnet 116 is located and attracts the shaft towards the metal base. Alternatively, or in conjunction, the drum 102 itself can be metallic and the electromagnet 116 can create an attractive magnetic force between portions of the drum and the shaft 112 upon the electromagnet's activation. The magnetic pulling force F created by the activated electromagnet 116 causes the metal base 118 and a portion of the drum 102 nearest the electromagnet to tend to move or deform slightly toward the shaft 112. When electric current to the electromagnet 116 ceases to flow, the electromagnet ceases to produce a magnetic field and stops pulling the metal base 118 toward the shaft 112. The drum 102 and the metal base 118 then return to their original, neutral force position with respect to the shaft 112. Activating and deactivating the electromagnet 116 in rapid succession causes the drum 102 to vibrate as the drum or metal base 118 moves towards and away from the electromagnet as it is turned on and off.

Figure 7:
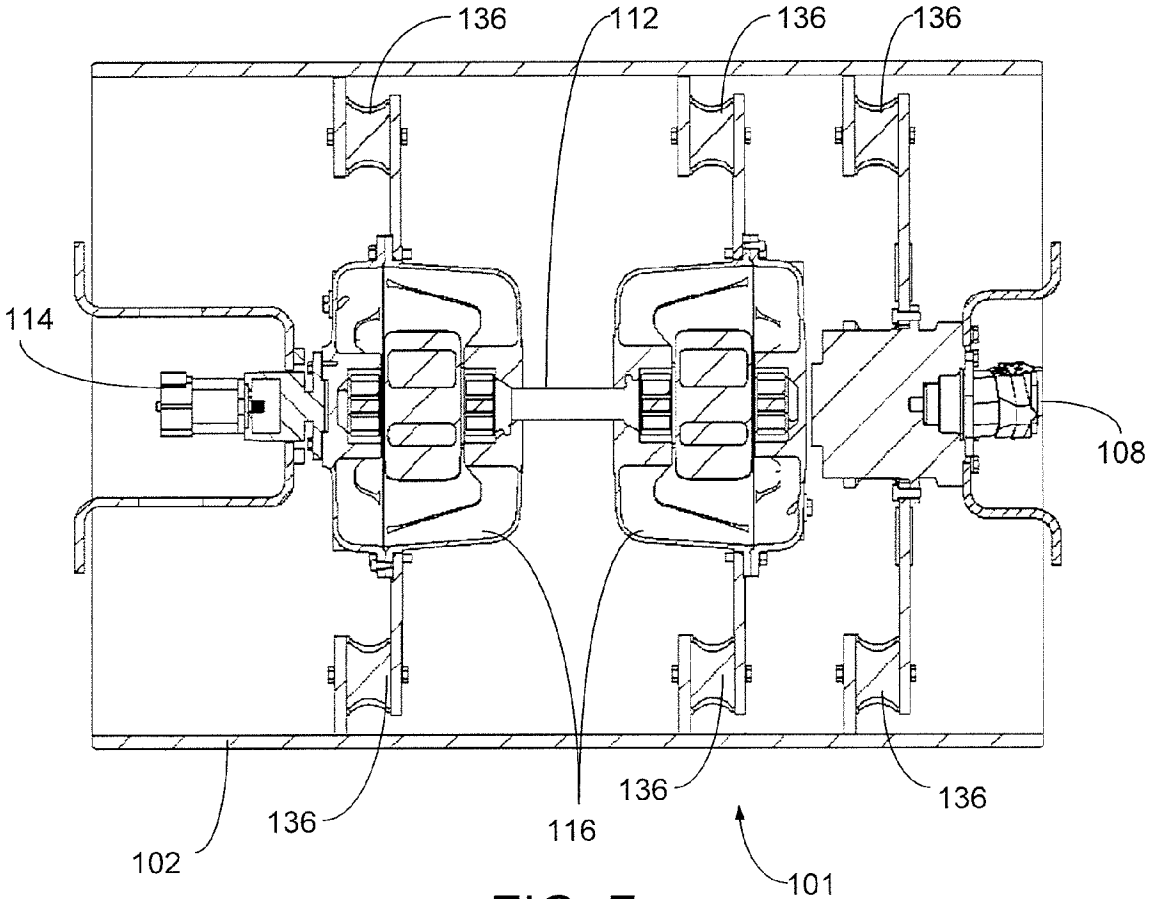
FIG. 7 is a cutaway perspective view of a drum of the magnetic vibratory compactor assembly in accordance with the disclosure.

Alternatively, the shaft 112 can be mounted using a resilient bushing 126. The bushing 126 is made from rubber or some other resilient, but flexible, material. When the electromagnet's 116 magnetic field is activated, the attractive force between the electromagnet mounted on the shaft 112 and the drum 102 causes the shaft to press against the bushing 126. The bushing 126 flexes, allowing the shaft 112 to move slightly off of the drum's 102 longitudinal direction in the direction of the magnetic force. The flexing distance provided by the bushing 126 allows displacement of the shaft 112 relative to the drum 102, which depends upon the strength of the magnetic field created by the electromagnet 116. When the electromagnet 116 deactivates, the bushing 126 forces the shaft 112 back to its original position on the longitudinal access of the drum 102. When the electromagnet 116 is selectively activated and deactivated repeatedly in succession, the force of the shaft 112 moving towards the drum 102 when the electromagnet 116 activates, and back into its original position in the bushing 126 when the electromagnet deactivates causes the drum 102 to vibrate. In other embodiments, such as in FIG. 7, the shaft 112 is connected to the drum 102 with isolation mounts 136. FIG. 7 represents a sectional view of the vibratory compactor assembly 101, the cross-section as depicted in FIG. 2, but illustrates a different embodiment than that shown in FIG. 2. The isolation mounts 136 allow the drum 102 to displace relative to the shaft 112 and thus vibrate when the electromagnets 116 are activated and deactivated in quick succession. The isolation mounts 136 also isolate that vibration from the rest of the vibratory compactor assembly 101 and the machine 100 as a whole. During use, the isolation mounts 136 deform slightly to allow the drum 102 to move toward the shaft 112 in response to the electromagnetic force pulling the drum toward the activated electromagnet 116. When the electromagnet 116 is no longer activated, the isolation mounts 136 move the drum 102 back to its original position with respect to the shaft 112.

Figure 4:
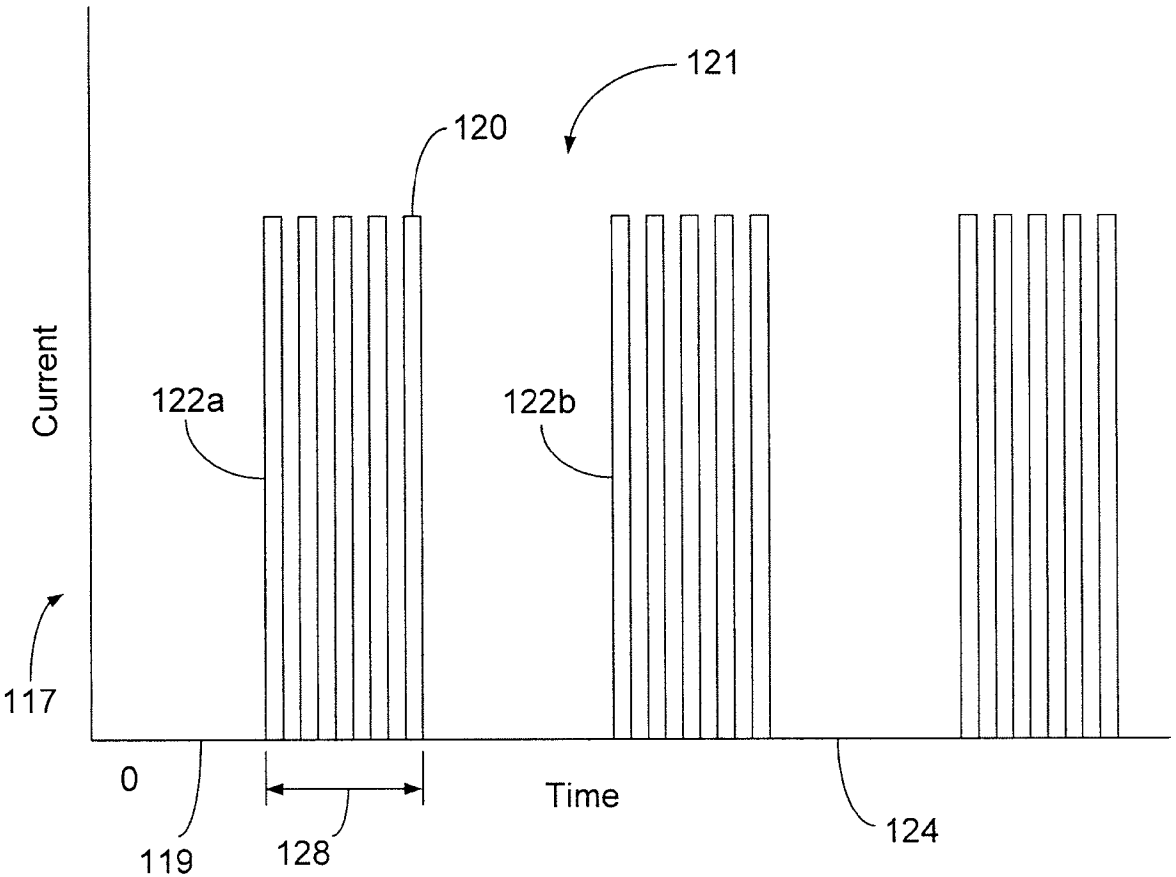
FIG. 4 is a graph plotting current flowing through an electromagnet over time in accordance with the disclosure.
Figure 6:
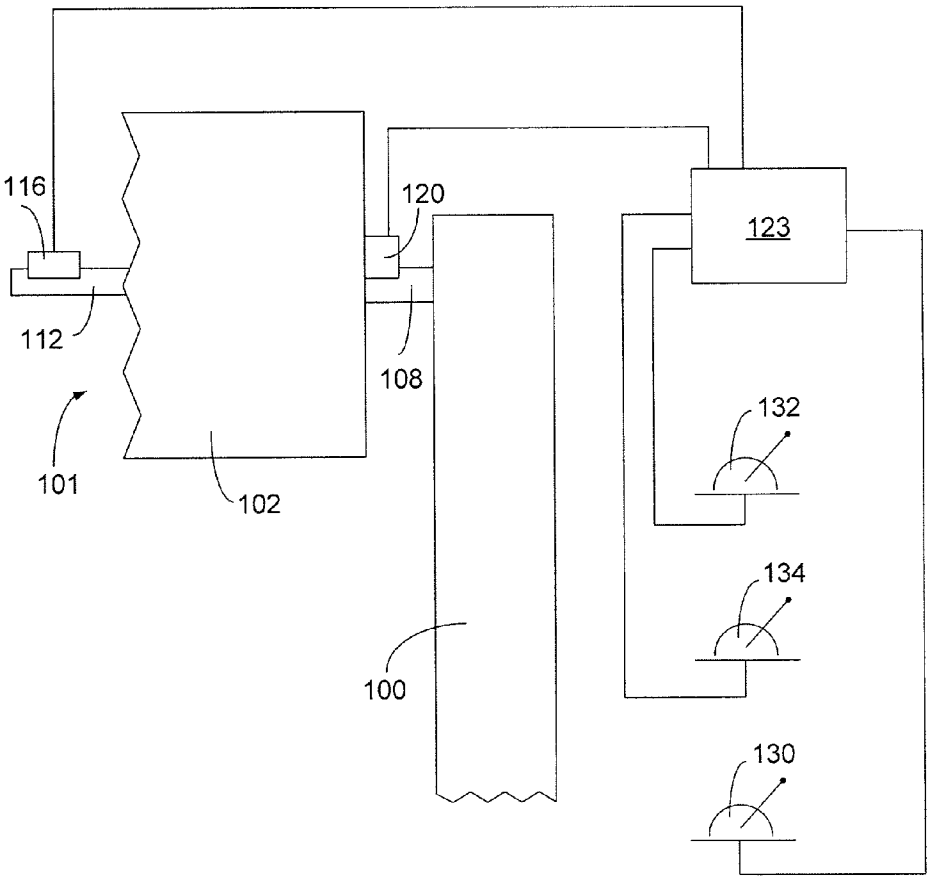
FIG. 6 is a schematic view of a machine having a magnetic vibratory compactor in accordance with the disclosure.

As shown in FIG. 6, controls 106 in the machine's 100 cab 104 allow an operator to switch the drum 102 between a non-vibrating and vibrating state using an activation control 130. When the operator switches the activation control 130 from the non-vibrating to the vibrating position, a controller 123 receives the signal and provides a proper signal to the electromagnet 116 in pulses that cause the electromagnet to activate and deactivate in rapid succession, resulting in drum 102 vibration. The amount of current provided through the electromagnet 116 can be modulated by any appropriate means, such as by use of a Pulse Width Modulated (PWM) signal provided to the electromagnet. When the electromagnet 116 is active and producing a magnetic force F, a PWM signal alternates quickly between supplying current and not supplying current to the electromagnet. As the graph 121 in FIG. 4 illustrates, the electric current flowing to the electromagnet 116 can be represented by a square wave. The vertical axis 117 of the graph 121 represents the magnitude of current flowing through the electromagnet 116, and the horizontal axis 119 represents time. The graph 121 shows the time periods 128 in which the electromagnet 116 is active. The proportion of 'on' time (when current is provided to the electromagnet 116) to the activation time period 128 is called the duty cycle. The strength of the electromagnet 116 depends on the power supplied to it. The larger the duty cycle used during the activation time periods 128, the higher the power is supplied to the electromagnet 116, and the higher the magnetic force. For example, a duty cycle of 50% indicates that the current is provided to the electromagnet 116 50% of the time that the electromagnet is activated. This would result in 50% of the power and, thus, 50% of the magnetic force F than if the duty cycle was 100%. The graph 121 in FIG. 4 represents a duty cycle of approximately 50% because current is provided to the electromagnet 116 about 50% of the time that the electromagnet is active. Since the duty cycle directly affects the magnetic force F, setting the amplitude of drum 102 vibration can be set by choosing a corresponding duty cycle.

The controls 106 allow the operator to set the amplitude of the drum's 102 vibration using the amplitude control 134. As illustrated schematically in FIG. 6, the amplitude control 134 is in communication with the controller 123, which receives the value of the amplitude control and provides the proper signal to the electromagnet 116. The amplitude control 134 adjusts the duty cycle of the PWM signal, which affects the strength of the magnetic force F. The duty cycle can be set at substantially any value between 0% and 100%. The stronger the force F pulling on the drum 102, the more the drum or the shaft 112 is displaced by the force, and the higher the amplitude of the drum vibration can become. Because the amplitude of the drum 102 vibration varies based on the duty cycle of the PWM signal provided through the electromagnet 116, the vibratory compactor assembly 101 can vibrate the drum at infinite amplitudes.

The operator can also use the controls 106 to set a value for the drum 102 vibration's frequency using the frequency control 132. The frequency control 132 determines the intervals in which the PWM signal flows to the electromagnet 116. The frequency control 132 is also in communication with the controller 123. The higher the vibration frequency the operator chooses, the less time passes between each activation time period 128 of the electromagnet 116. The activation time period 128 represent moments in time when a PWM signal is provided to the electromagnet 116 and, thus, magnetic forces are pulling the drum 102 toward the shaft 112 or pulling the shaft toward the drum. As FIG. 4 illustrates, between each activation time period, the current is at zero or near zero, which results in negligible or no magnetic force applied between the drum 102 and the shaft 112. The frequency of a given wave can be determined by measuring the time between the front 122*a* of given wave and the front 122*b* of an adjacent wave. The amplitude of the square wave is determined by measuring the difference in the current at the wave's trough 124 and the wave's peak 120. The amplitude of the drum 102 vibration is directly related to the duty cycle of the PWM signal applied to the electromagnet 116.

Figure 5:
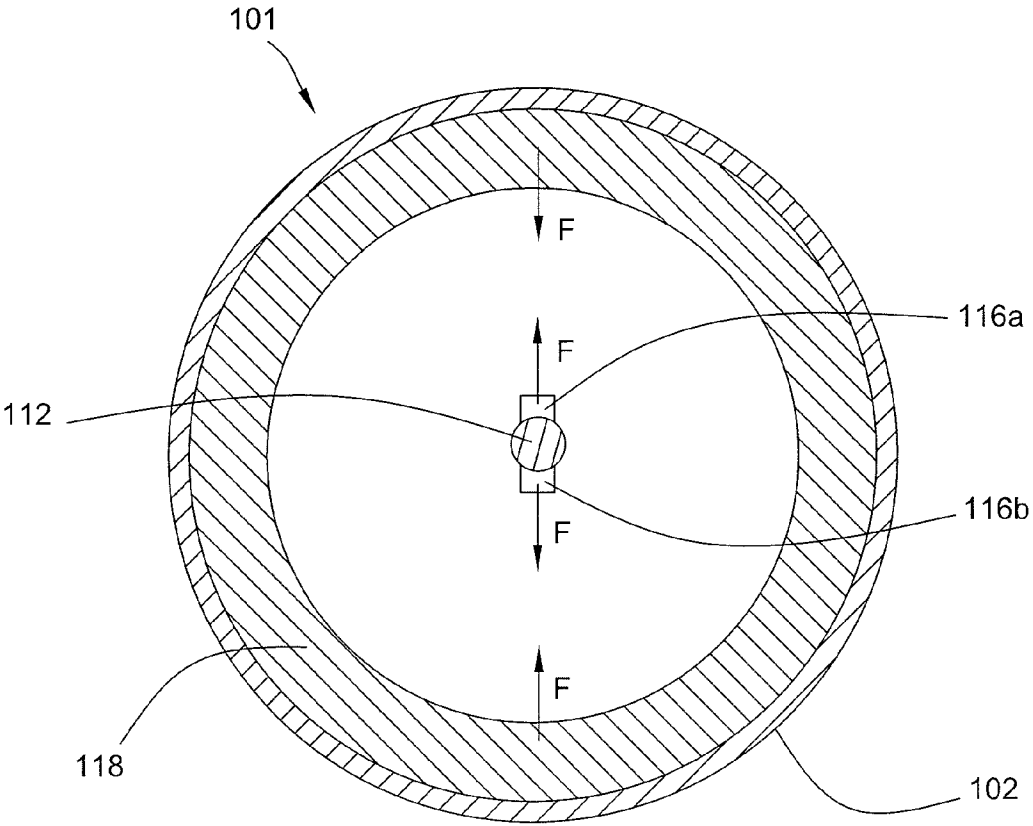
FIG. 5 is a side schematic view of a further embodiment of a drum of the magnetic vibratory compactor of FIG. 2.

Other embodiments of the shaft 112 have multiple electromagnets 116 attached to its circumference. For example, some embodiments have multiple electromagnets 116 attached to one side of the shaft 112, while others have one or multiple electromagnets attached to both opposing sides of the shaft. FIG. 5 illustrates an embodiment having electromagnets 116*a*, 116*b* on opposing sides of the shaft 112. The two electromagnets 116*a*, 116*b* work in conjunction with one another when the operator activates the drum 102 vibration. Each of the electromagnets 116*a*, 116*b* can be activated in succession. For example, when the operator activates the drum 102 vibration, current runs first through electromagnet 116*a*, then runs through electromagnet 116*b*. The current then continues switching from electromagnet 116*a* to electromagnet 116*b* for as long as drum 102 vibration is active. When electromagnet 116*a* activates from current flow, it creates a magnetic force that pulls the top of the drum 102 downward toward the shaft 112 or pulls the shaft upward towards the drum. Subsequently, when electromagnet 116*b* is activated, it pulls the bottom of the drum 102 upward towards the shaft 112 or pulls the shaft downward toward the drum. When the two electromagnets 116*a*, 116*b* are activated in conjunction, the drum 102 can vibrate with a larger amplitude than when only one electromagnet is used because magnetic forces pull on both the top and bottom of the drum, or the top and bottom of the shaft 112. With only one electromagnet 116, such as in FIG. 3, the shaft 112 moves toward the drum 102 against the resilient bushing 126 in response to the magnetic force F and then moves back to its original position in response to the bushing's resiliency. With multiple electromagnets 116*a*, 116*b*, such as in FIG. 5, the shaft 112 moves downward against the resilient bushing 126 toward the drum 102 when electromagnet 116*b* is activated, then moves upward toward the drum when electromagnet 116*b* is deactivated and electromagnet 116*a* is activated. When the shaft 112 moves upward and downward against the resilient bushing 126 in rapid succession, the drum 102 vibrates with about twice the amplitude as when only one electromagnet 116 is used. Additionally, multiple electromagnets 116 allow the drum 102 to vibrate at a higher frequency relative to vibration induced by a single magnet. For example, when used in conjunction, two electromagnets 116 can apply an electromagnetic force to the drum 102 at double the frequency possible than when only one electromagnet is used, by alternating the activation of the electromagnets.

INDUSTRIAL APPLICABILITY

The industrial application of the apparatus and methods for a magnetic vibratory compactor in a machine as described herein should be readily appreciated from the foregoing discussion. The present disclosure is applicable to any type of machine using a drum compactor. It is particularly useful when operators need to use a range of vibration amplitudes and frequencies for different types of applications such as asphalt, dirt, or other materials. The operator can easily set the frequency, amplitude, and duty cycle of the vibrations with the machine's controls.

The disclosure, therefore, is applicable to many different machines and environments. One exemplary machine suited to the disclosure is a vibratory asphalt compactor. These compactors are commonly used in road and highway construction sites and other areas having various different materials needing compacting. Thus, a magnetic vibratory compactor allows a machine operator to set infinite vibration amplitudes and frequencies within a range depending on an application's requirements.

Further, the apparatus and methods above can be adapted to a large variety of machines. For example, other types of industrial machines, such as soil compactors, landfill compactors, and many other machines can benefit from the methods and systems described.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A machine comprising:

a vibratory compactor assembly, the vibratory compactor assembly comprising:

a cylindrical drum connected to the machine by at least one axle;

a shaft extending concentrically at least through the center of the cylindrical drum, the shaft having a first end and a second end;

at least one electromagnet disposed on the shaft within the cylindrical drum and between the first end and the second end, the at least one electromagnet being configured to maintain a consistent orientation with respect to the machine;

wherein the electromagnet is configured to receive electric current to create a magnetic field that applies an attractive magnetic force between the shaft and the drum that pulls the shaft and at least a portion of the drum toward one another when the electromagnet is active such that a vibration between the shaft and the drum can be induced when the electromagnet is activated and deactivated at a predetermined frequency.

2. The machine of claim 1, further comprising controls adapted to activate and deactivate the at least one electromagnet such that a vibration of the cylindrical drum relative to the shaft can be provided, the vibration having an infinitely selectable frequency and amplitude.

3. The machine of claim 2, wherein the controls are further adapted to set one of the amplitude of the drum vibration and the frequency at which the electromagnet is activated and deactivated.

4. The machine of claim 1, further comprising at least one resilient bushing disposed between the shaft and the drum and configured to provide a displacement therebetween when the electromagnet is active.

5. The machine of claim 1, wherein the vibratory compactor further comprises a motor disposed on the shaft, wherein the motor is configured to rotate the shaft in a direction opposite to the rotation of the drum when the drum rotates.

6. The machine of claim 1, wherein the vibratory compactor further comprises a gearing mechanism, wherein the gearing mechanism is configured to rotate the shaft in a direction opposite to the rotation of the drum when the drum rotates.

7. The machine of claim 1, wherein at least one electromagnet is disposed on a first side of the shaft, and at least one additional electromagnet is disposed on a second side of the shaft opposite the first side.

8. A vibratory compactor assembly comprising:

a cylindrical drum;

a shaft extending concentrically at least through the center of the cylindrical drum, the shaft having a first end and a second end;

at least one electromagnet disposed on the shaft within the cylindrical drum and between the first end and the second end, the at least one electromagnet being configured to maintain a consistent orientation with respect to the machine;

wherein the electromagnet is configured to receive electric current to create a magnetic field that applies an attractive magnetic force between the shaft and the drum that pulls the shaft and at least a portion of the drum toward one another when the electromagnet is active such that a vibration between the shaft and the drum can be induced when the electromagnet is activated and deactivated at a predetermined frequency.

9. The vibratory compactor assembly of claim 8 further comprising an electric controller configured to activate and deactivate the at least one electromagnet such that a vibration of the cylindrical drum relative to the shaft can be provided, the vibration having an infinitely selectable frequency and amplitude.

10. The vibratory compactor assembly of claim 9, wherein the controls are further adapted to set one of the amplitude of the drum vibration and the frequency at which the electromagnet is activated and deactivated.

11. The vibratory compactor assembly of claim 8, further comprising at least one resilient bushing disposed between the shaft and the drum and configured to provide a displacement therebetween when the electromagnet is active.

12. The vibratory compactor assembly of claim 8, wherein the vibratory compactor further comprises a motor disposed on the shaft, wherein the motor is configured to rotate the shaft in a direction opposite to the rotation of the drum when the drum rotates.

13. The vibratory compactor assembly of claim 8, wherein the vibratory compactor further comprises a gearing mechanism, wherein the gearing mechanism is configured to rotate the shaft in a direction opposite to the rotation of the drum when the drum rotates.

14. The vibratory compactor assembly of claim 8, wherein at least one electromagnet is disposed on a first side of the shaft, and at least one additional electromagnet is disposed on a second side of the shaft opposite the first side.

15. A method of vibratory compaction for a machine, the method comprising:

providing a vibratory compactor assembly, the vibratory compactor assembly comprising:

rotating a cylindrical drum;

rotating a shaft having a first end and a second end in the opposite direction as the drum, the shaft extending concentrically at least through the center of the cylindrical drum;

providing one electromagnet disposed on the shaft within the cylindrical drum and between the first end and the second end, the at least one electromagnet being configured to maintain a consistent orientation with respect to the machine;

providing the electromagnet with electric current to create a magnetic field that applies an attractive magnetic force between the shaft and the drum that pulls the shaft and at least a portion of the drum toward one another when the electromagnet is active such that a vibration between the shaft and the drum can be induced when the electromagnet is activated and deactivated at a predetermined frequency.

16. The method of vibratory compaction of claim 15, the method further comprising activating and deactivating the at least one electromagnet using an electronic controller such that a vibration of the cylindrical drum relative to the shaft can be provided, the vibration having an infinitely selectable frequency and amplitude.

17. The method of vibratory compaction of claim 16, the method further comprising using the electronic controller to set one of the amplitude of the drum vibration and the frequency at which the electromagnet is activated and deactivated.

18. The method of vibratory compaction of claim 15, further comprising at least one resilient bushing disposed between the shaft and the drum and configured to provide a displacement therebetween when the electromagnet is active.

19. The method of vibratory compaction of claim 15, the method further comprising providing a motor disposed on the shaft and using the motor to rotate the shaft in a direction opposite to the rotation of the drum when the drum rotates.

20. The method of vibratory compaction of claim 15, the method further comprising providing a gearing mechanism disposed on the shaft and using the gearing mechanism to rotate the shaft in a direction opposite to the rotation of the drum when the drum rotates.

* * * * *